US012421013B1

(12) United States Patent
Liu et al.

(10) Patent No.: US 12,421,013 B1
(45) Date of Patent: Sep. 23, 2025

(54) MULTI-FUNCTIONAL FLEXIBLE STEAMER USED FOR MICROWAVE OVEN

(71) Applicant: WELLFINE SILICONE PRODUCTS CO., LTD., Guangdong (CN)

(72) Inventors: Feng Liu, Guangdong (CN); Shihao Wang, Guangdong (CN)

(73) Assignee: WELLFINE SILICONE PRODUCTS CO., LTD., Dongguan (CN)

( * ) Notice: Subject to any disclaimer, the term of this patent is extended or adjusted under 35 U.S.C. 154(b) by 0 days.

(21) Appl. No.: 19/079,203

(22) Filed: Mar. 13, 2025

(30) Foreign Application Priority Data

Mar. 6, 2025 (CN) ..... 202520388087.8

(51) Int. Cl.
*H05B 6/64* (2006.01)
*B65D 81/34* (2006.01)
*B65D 53/00* (2006.01)

(52) U.S. Cl.
CPC ..... *B65D 81/3461* (2013.01); *B65D 53/00* (2013.01); *B65D 2581/3422* (2013.01); *B65D 2581/3433* (2013.01)

(58) Field of Classification Search
CPC ..... B65D 81/3461; B65D 53/00; B65D 2581/3422; B65D 2581/3433; A47J 27/00; A47J 27/04; H05B 6/64
USPC ..... 219/725, 729, 730, 732, 734, 735, 759, 219/733
See application file for complete search history.

(56) References Cited

U.S. PATENT DOCUMENTS

2014/0224799 A1* 8/2014 Iwasaki ..... B65D 45/22 220/254.4
2016/0255984 A1* 9/2016 Affatato ..... A47J 27/04

FOREIGN PATENT DOCUMENTS

JP 3164163 U * 11/2010
KR 20230175005 A * 12/2023 ..... A47J 27/04

OTHER PUBLICATIONS

Translation of KR2023/0175005A, "a Rice Cake Steamer For Microwave", Dec. 29, 2023, By Espacenet. (Year: 2023).*

* cited by examiner

*Primary Examiner* — Quang T Van
(74) *Attorney, Agent, or Firm* — HOWARD M COHN and Associates, LLC

(57) ABSTRACT

The present disclosure provides a multi-functional flexible steamer used for a microwave oven that includes a first body including a first receiving room with an opened-end top portion thereof; a second body including a second receiving room with an opened-end top portion thereof; a plurality of holes arranged on a bottom end of the second body and connected to the second receiving room. The second body can be placed on the first body so that the bottom end of the second body extends into the first receiving room; and a cover that can be placed on the second body or on the first body. The first and second bodies, and the cover are all made of materials that are flexible and resistant to be heated in a microwave oven.

11 Claims, 16 Drawing Sheets

MULTI-FUNCTIONAL FLEXIBLE STEAMER USED FOR MICROWAVE OVEN

BACKGROUND

1. Technical Field

The present disclosure generally relates to the technical field of steamers made of flexible materials, and especially relates to a multi-functional flexible steamer used for heating food in a microwave oven.

2. Description of Related Art

Microwave ovens are widely used in daily life, such as at home and in offices, due to their ability to quickly heat food. Especially for office workers that bring their own ingredients for heating the ingredients in a microwave oven at the company, which is fast and hygienic.

When is needs to heat food in the microwave oven, the food is put into a container and then the container is put into the microwave oven for being heated.

The conventional container that is received in the microwave oven is generally made of materials such as glass, ceramic and plastic, etc., which has some disadvantages shown below.

First, the structure and functions are simple, which is generally only used for receiving food and has a single heating function, without being able to steam rice, vegetables, eggs, or cook congee and other cooking functions.

Second, it is unable to separate sugar and oil that are in foods.

Third, a weight of the container is heavy so that it is inconvenient to be carried, and is not collision and fall resistant.

Fourth, the container is made of plastic materials, which is prone to deformation and produce toxic substances when the container is heated.

In addition, the conventional steamers are generally stainless steel pots with large volumes, which can't be placed in the microwave oven and are inconvenient to be carried on a daily basis for office workers.

Therefore, the related art needs to be improved.

SUMMARY

The technical problems to be solved: in view of the shortcomings of the related art, the present disclosure provides a multi-functional flexible steamer used for a microwave oven, which can be placed in a microwave oven to heat and steam food, and can also leak sugar and oil of the food through holes thereof, so that the steamed food is healthier, lightweight and easy to be carried.

The technical solution adopted for solving technical problems of the present disclosure is to provide a multi-functional flexible steamer used for a microwave oven, wherein the multi-functional flexible steamer includes:

a first body including a first receiving room with an opened-end top portion thereof;

a second body including a second receiving room with an opened-end top portion thereof, and a plurality of holes arranged on a bottom end of the second body and connected to the second receiving room; and wherein the second body can be placed on the first body so that the bottom end of the second body extends into the first receiving room; and a cover covered on the second body or the first body; and wherein all the first body, the second body and the cover are made of materials that are flexible and resistant to be heated in a microwave oven.

Wherein the multi-functional flexible steamer is made of silicone rubber.

Wherein the multi-functional flexible steamer includes at least two usage combination modes, wherein a first usage combination mode is a combination of the first body, the second body and the cover; and a second combination mode is a combination of the first body and the cover.

Wherein the second body includes a first spacer arranged in the second receiving room to divide the second receiving room into at least two cavities, wherein the plurality of holes is arranged on a bottom of at least one of the at least two cavities, and there is no holes arranged on a bottom of the other of the at least two cavities for resulting in a sealed state at the bottom thereof.

Wherein the first body includes a second spacer arranged in the first receiving room to divide the first receiving room into at least two cavities.

Wherein the second body includes an exposing portion and an inserting portion arranged below the exposing portion, and a transition step formed at a connection between the exposing portion and the inserting portion;

the inserting portion configured to extend into the first receiving room; and wherein an upper end of the first body is connected to the transition step of the second body through a first anti-stop structure, and the cover is connected to the exposing portion of the second body through a second anti-stop structure.

Wherein the first anti-stop structure includes:

a first plugging slot arranged on the transition step of the second body;

a first protrusion arranged on the upper end of the first body; or the first anti-stop structure includes:

a first protrusion arranged on the transition step of the second body, and a first plugging slot arranged on the upper end of the first body; and wherein when the inserting portion of the second body is inserted into the first receiving room of the first body, the first protrusion is inserted into the first plugging slot.

Wherein when the inserting portion extends into the first receiving room, an outer wall of the inserting portion tightly fits with an inner wall of the first body.

Wherein a sealing rib is formed on the outer wall of the inserting portion, and a sealing groove is formed on the inner wall of the first body; or a sealing groove is formed on the outer wall of the inserting portion, and a sealing rib is formed on the inner wall of the first body; and wherein the sealing rib is embedded into the sealing groove.

Wherein the cover includes a base, a clamping block arranged on a lower portion of the base; and wherein the second anti-stop structure includes:

a U-shaped groove arranged on a side of the clamping block that faces the second body;

a U-shaped protrusion arranged on a top end of the exposing portion of the second body; or the second anti-stop structure includes:

a U-shaped protrusion arranged on a side of the clamping block that faces the second body;

a U-shaped groove arranged on a top end of the exposing portion of the second body; and wherein when the cover covers on the exposing portion of the second body, the U-shaped protrusion is inserted into the U-shaped groove.

Wherein a sealing groove is arranged on a groove wall of the U-shaped groove, and a sealing rib is arranged on an inner wall of the top end of the exposing portion; or a sealing rib is arranged on a groove wall of the U-shaped groove, and a sealing groove is arranged on an inner wall of the top end of the exposing portion; and wherein the sealing rib is embedded into the sealing groove.

Wherein the cover includes a base, a first inserting wall arranged downwards at the lower portion of the base, and a fastening step arranged on an outside of the first inserting wall; and wherein the second anti-stop structure includes:

a second plugging slot arranged on the fastening step;

a second protrusion arranged on the top end of the exposing portion; or the second anti-stop structure includes:

a second protrusion arranged on the fastening step;

a second plugging slot arranged on the top end of the exposing portion; and wherein when the cover covers on the exposing portion of the second body, the second protrusion is inserted into the second plugging slot.

Wherein a sealing rib is formed on an outer wall of the first inserting wall, and a sealing groove is formed on an inner wall of the top end of the exposing portion of the second body; or a sealing groove is formed on an outer wall of the first inserting wall, and a sealing rib is formed on an inner wall of the top end of the exposing portion of the second body; and wherein the sealing rib is embedded into the sealing groove.

Wherein the second body includes an inserting portion and a first connecting step arranged on a top outer side of the inserting portion;

a second connecting step arranged on a top inner side of the first body; and wherein when the inserting portion of the second body is inserted into the first receiving room of the first body, the first connecting step of the second body is overlapped on the second connecting step of the first body; and wherein the cover includes a base, a second inserting wall arranged downwards at a lower portion of the base, and a cover plate arranged on the outer side of the second inserting wall, wherein the cover plate presses onto the first connecting step or the second connecting step.

Wherein a sealing rib is formed on an outer wall of the second inserting wall, and a sealing groove is formed on a top inner side of the inserting portion of the second body; or a sealing groove is formed on an outer wall of the second inserting wall, and a sealing rib is formed on a top inner side of the inserting portion of the second body; and wherein the sealing rib is embedded into the sealing groove.

Wherein the cover includes a buckling ear, and a buckling portion arranged on the outer wall of the first body, a buckling hole formed on the buckling ear to buckle with the buckling portion.

Wherein a shape of the multi-functional flexible steamer is rectangular or circular.

It should be understood that within the scope of the present disclosure, the above-mentioned technical features of the present disclosure and the specific technical features described in the following (such as embodiments) can be combined with each other to form new or preferred technical solutions, which will not be repeated here due to space limitations thereof.

The present disclosure provides the advantages as below.

The present disclosure provides the first body, the second body and the cover that are made flexible materials, especially silicone materials. In this way, the first body, the second body and the cover are cooperatively to form a steamer, the first body can be filled with water, while the second body can be filled with ingredients such as raw rice, vegetables and eggs etc., and then the steamer is heated and steamed in a microwave oven. Because the plurality of holes is formed at the bottom end of the second body, during the cooking process, some sugar on surfaces of rice will enter the first body through the plurality of holes with water, which plays a role in reducing blood sugar. For example, oil and fat from meat can also enter the first body through the plurality of holes, thereby reducing fat thereof. At the same time, the food that has cooked can also be directly placed on the first body, to be heated directly in the microwave oven, that is, the steamer of the present disclosure can be configured to perform steaming and boiling functions by combining with the first body, the second body and the cover. Furthermore, a combination of the first body and the cover can be used for performing a simple heating function, which has a diversity of functions; and the microwave steamer of the present disclosure is made of flexible materials, which is lightweight and easy to be carried.

BRIEF DESCRIPTION OF THE DRAWINGS

In order to more clearly understand the technical solution hereinafter in embodiments of the present disclosure, a brief description to the drawings used in detailed description of embodiments hereinafter is provided thereof. Obviously, the drawings described below are some embodiments of the present disclosure, for one of ordinary skill in the related art, other drawings can be obtained according to the drawings below on the premise of no creative work.

Figure 1:
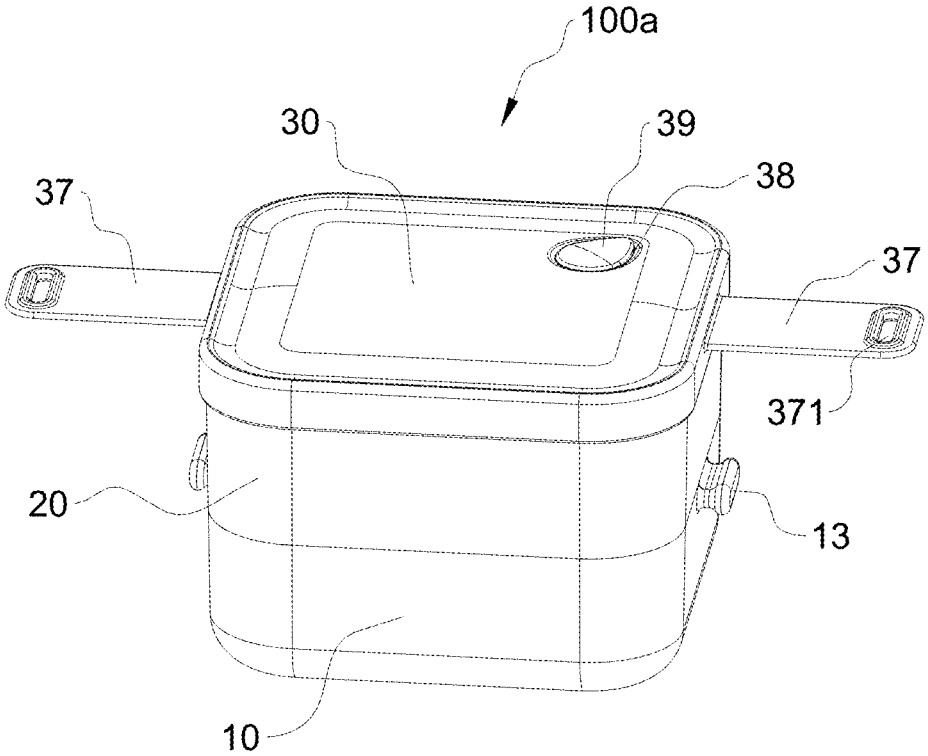
FIG. 1 is a schematic view of a multi-functional flexible steamer used for a microwave oven in accordance with a first embodiment of the present disclosure.

The element labels according to the exemplary embodiment of the present disclosure shown as below:

100*a*, 100*b*, 100*c* steamer, 10 first body, 101 upper end, 102, 231 inner wall, 103, 233, 245, 512 sealing groove, 104, 244 top inner side, 105, 241, 331, 351 outer wall, 11 first receiving room, 110, 210 cavity, 111, 211 top portion, 112 second spacer, 12 second connecting step, 13 buckling portion, 14 second bar, 20 second body, 201 bottom end, 21 second receiving room, 212 first spacer, 22 hole, 23 exposing portion, 230 top end, 232, 242, 332, 352 sealing rib, 24 inserting portion, 243 top outer side, 25 transition step, 26 first connecting step, 28 first bar, 30 cover, 301 handle, 31 base, 311 lower portion, 32 clamping block, 33 first inserting wall, 34 fastening step, 35 second inserting wall, 36 cover plate, 37 buckling ear, 371 buckling hole, 38 exhaust vent, 39 exhaust cover, 40 first anti-stop structure, 41 first plugging slot, 42 first protrusion, 50 second anti-stop structure, 51 U-shaped groove, 511 groove wall, 52 U-shaped protrusion, 53 second plugging slot, 54 second protrusion.

DETAILED DESCRIPTION

Reference will now be made in detail to embodiments, examples of which are illustrated in the accompanying drawings. In the following detailed description, numerous specific details are set forth in order to provide a thorough understanding of the subject matter presented herein. Obviously, the implementation embodiment in the description is a part of the present disclosure implementation examples, rather than the implementation of all embodiments, examples. According to the described embodiment of the present disclosure, all other embodiments obtained by one of ordinary skill in the related art on the premise of no creative work are within the protection scope of the present disclosure.

In the description of the present disclosure, it needs to be explained that all the directional indicators (such as the terms: "upper", "below", "left", "right", "front", "back" . . . ), are shown in the specification of the present disclosure. The indicated orientation or position of the terms shown in the detailed description is based on the orientation or position shown in the figures of the accompanying drawings of the present disclosure, which is only to easily simplify the description of the present disclosure, but not indicated that the devices or elements of the present disclosure should have a particular orientation or should be designed and operated in a particular orientation. So the terms illustrated in the detail description are not by way of the limitation of the present disclosure.

Furthermore, in the description of the present disclosure, the terms such as "first" and "second" shown in the specification are only used to describe, but not indicated that the elements of the present disclosure is important or represented the amount of the elements. That is, the features limited by the terms of "first" and "second" may explicitly or implicitly include one or more features.

Referring to FIG. 1 to FIG. 7, a multi-functional flexible steamer used for a microwave oven 100*a* according to a first embodiment of the present disclosure includes: a first body 10, a second body 20 and a cover 30. The second body 20 is arranged between the first body 10 and the cover 30. all the first body 10, the second body 20 and the cover 30 of the present disclosure are made of materials that are flexible and resistant to be heated in a microwave oven. In this way, the steamer 100*a* that is consisted of the first body 10, the second body 20 and the cover 30, is lightweight and easy to be carried. At the same time, due to its high temperature resistance, such as being able to withstand a high temperature up to about 200 degrees, a heating temperature of the microwave oven is generally around 120 degrees, the flexible material steamer 100*a* of the present disclosure can be placed in a microwave oven for be heated. The flexible and microwave resistant material of the present disclosure can be materials such as silicone rubber and non-toxic soft plastics etc.

The multi-functional flexible steamer 100 of the present disclosure can be designed to various shapes, such as rectangular, circular, etc. In the first embodiment of the present disclosure, all the first body 10, the second body 20 and the cover 30 are rectangular.

Preferably, the multi-functional flexible steamer 100 in embodiments of the present disclosure is made of silicone rubber, which is a food grade material that is safe and hygienic.

Referring to FIG. 1, the cover 30 of the first embodiment is provided with an exhaust vent 38, and a detachable exhaust cover 39 is provided on the exhaust vent 38. The exhaust vent 38 is configured to discharge a steam generated during cooking food in the steamer 100*a*.

Figure 2:
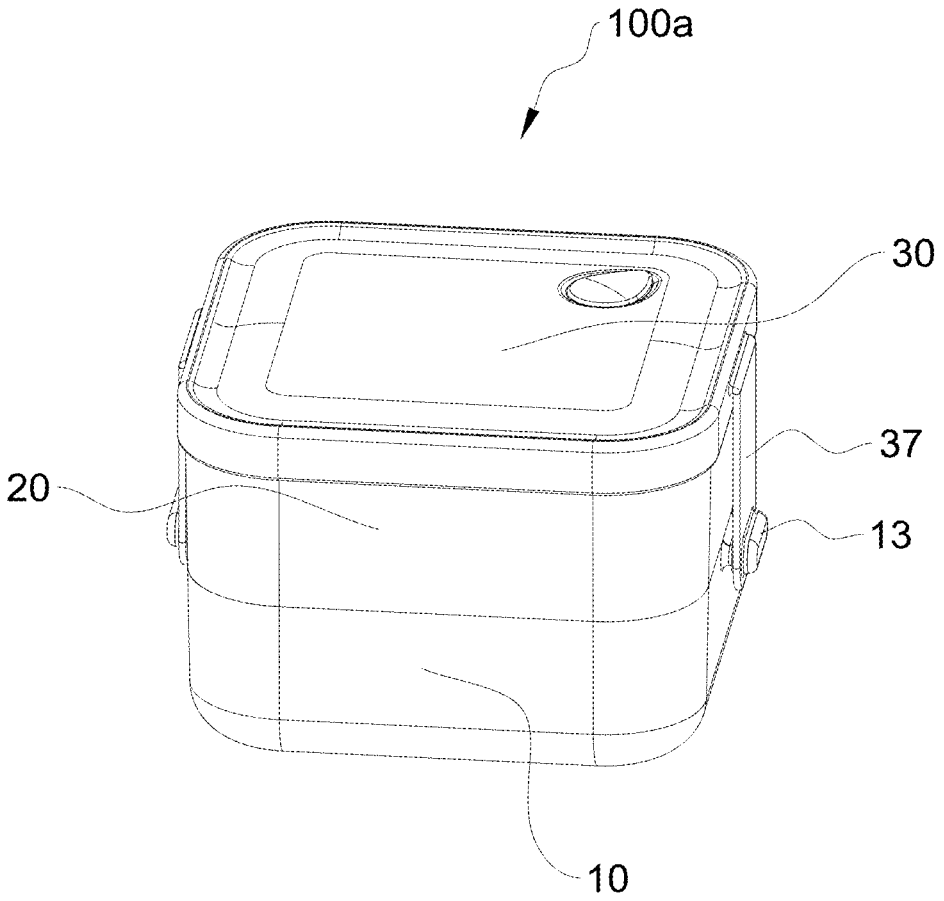
FIG. 2 is similar to FIG. 1, but shown the multi-functional flexible steamer in another state.

Preferably, referring to FIG. 1, the cover 30 includes a buckling ear 37, and a buckling portion 13 arranged on an outer wall 105 of the first body 10, a buckling hole 371 formed on the buckling ear 37 to buckle with the buckling portion 13. Referring to FIG. 2, the buckling ear 37 and the buckling portion 13 are buckled with each other, which can increase firmness between the first body 10, the second body 20 and the cover 30 after they are closed.

Figure 3:
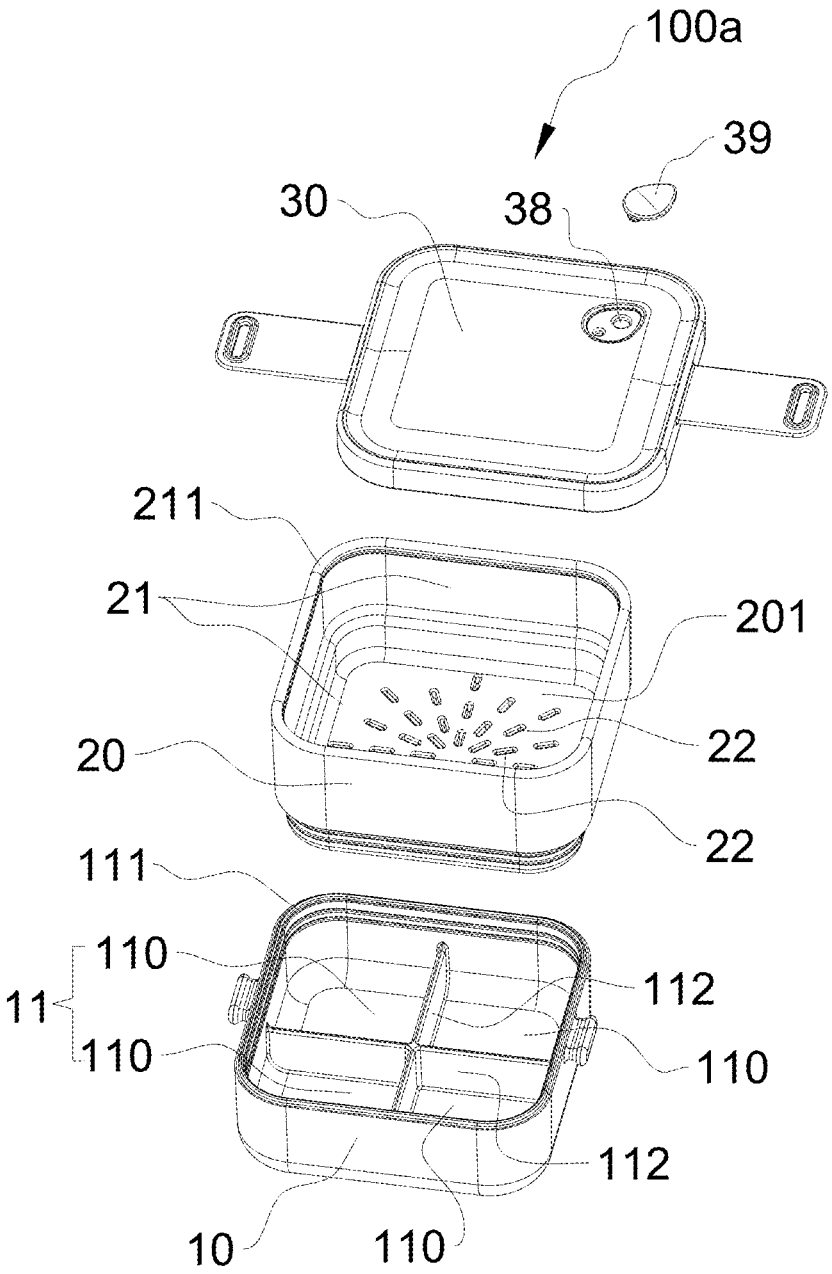
FIG. 3 is an exploded, schematic view of the multi-functional flexible steamer of FIG. 1.
Figure 4:
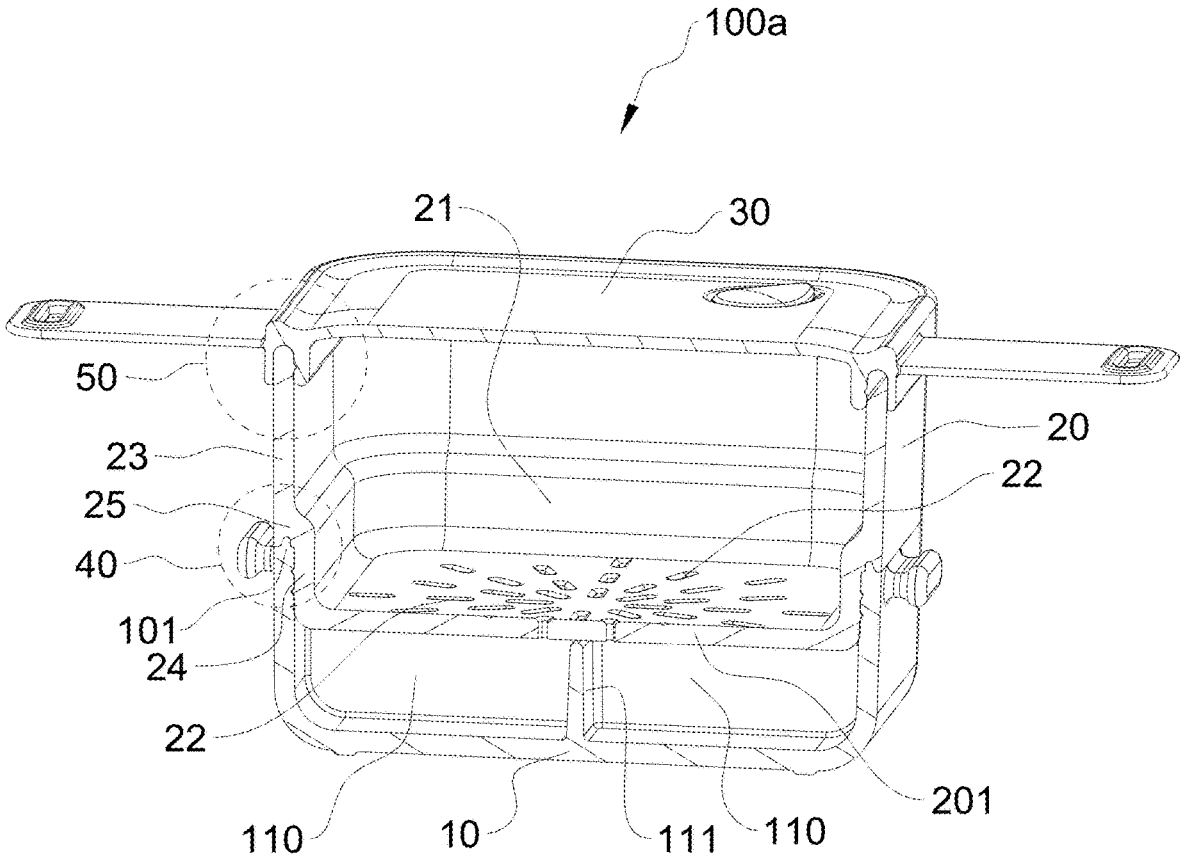
FIG. 4 is a cross-sectional view of the multi-functional flexible steamer of FIG. 1.

Specifically, referring to FIG. 3 and FIG. 4, in the first embodiment of the present disclosure, the first body 10 includes a first receiving room 11 with an opened-end top portion 111 thereof. The top portion 111 of the first receiving room 11 is open to conveniently fill water or food into the first receiving room 11, and also allows the second body 20 to be set on the top portion 111 of the first receiving room 11 of the first body 10. Liking conventional pots in the related art, the bottom of the first body 10 is sealed.

The second body 20 of the first embodiment includes a second receiving room 21 with an opened-end top portion 211 thereof. The top portion 211 of the second receiving room 21 is open to be also convenient for placing ingredients to be steamed into the second receiving room 21, and also can allow the cover 30 to be placed on the top portion 211 of the second receiving room 21 of the second body 20.

It is unlike conventional pots, a bottom end 201 of the second body 20 of the first embodiment is provided with a plurality of holes 22 that communicates with the second receiving room 21. In this way, the second body 20 can be used for steaming and cooking food, that is, steam can enter the second body 20 through the plurality of holes 22 to steam and cook the food in the second receiving room 21. A size of the hole 22 is mainly aimed at not missing food particles, such as a size that is designed to be smaller than an outer diameter of conventional rice grains.

The second body 20 can be placed on the first body 10 so that the bottom end 201 of the second body 20 extends into the first receiving room 11. Referring to FIG. 4, the second body 20 is placed on the first body 10 and the bottom end 201 of the second body 20 extends into the first receiving room 11.

A specific steaming process is shown in FIG. 4. Adding an appropriate amount of water to the first receiving room 11 of the first body 10, and then putting ingredients such as rice, meat, vegetables and eggs, etc. into the second receiving room 21 of the second body 20, covering the cover 30 and open the exhaust cover 39 at the top of the cover 30 and then placing the steamer 100*a* into the microwave oven for heating and cooking the food. Alternatively, uncovering the cover 30 and directly placing the first body 10 and the second body 20 that are stacked together in the microwave oven for heating and cooking the food. During the steaming and cooking process, heat generated by the microwave oven simultaneously heats both the first body 10 and the second body 20. The water in the first body 10 is heated and turned into steam, which enters the food that is in the second receiving room 21 of the second body 20 through the plurality of holes 22 at the bottom of the second body 20 to heat the food. In this way, the food in the second receiving room 21 is heated by both the microwave oven and the steam, so that it can be quickly steamed. At the same time, sugars on surfaces of the rice will flow into the first body 10 with the water through the plurality of holes 22, so the steamer 100*a* of the present disclosure can reduce the sugar of the rice to obtain low sugar rice noodles, which is more conducive to health. At the same time, when cooking meat, oil produced during cooking the meat will also flow into the first body 10 through the plurality of holes 22, thus playing the role of reducing fat thereof.

The cover 30 of the steamer 100*a* in the first embodiment can be covered on the second body 20 or the first body 10, so that the steamer 100*a* of the present disclosure can obtain a plurality of usage combination modes, such as a combination of the first body 10, the second body 20 and the cover 30; a combination of the first body 10 and the cover 30, and a combination of the second body 20 and the cover 30. Users can choose combinations according to their own usage needs, if it needs to steam and cook raw food, it can choose the combination of the first body 10, the second body 20 and the cover 30 to have a steaming and cooking function thereof; if it needs to heat cooked food briefly, it can choose the combination of the first body 10 and the cover 30 to put the cooked food into the first body 10 and then directly put into the microwave oven for simple heating the cooked food.

The multi-functional flexible steamer 100*a* of the first embodiment at least includes two combination usage modes. A first combination mode is a combination of the first body 10, the second body 20 and the cover 30, which is shown in FIG. 1 to FIG. 7, that is the first combination usage mode of the multi-functional flexible steamer 100*a* of the first embodiment. In this usage mode, the steamer 100*a* of the first embodiment can be placed in the microwave oven for steaming rice, vegetables, eggs and other functions thereof.

Figure 8:
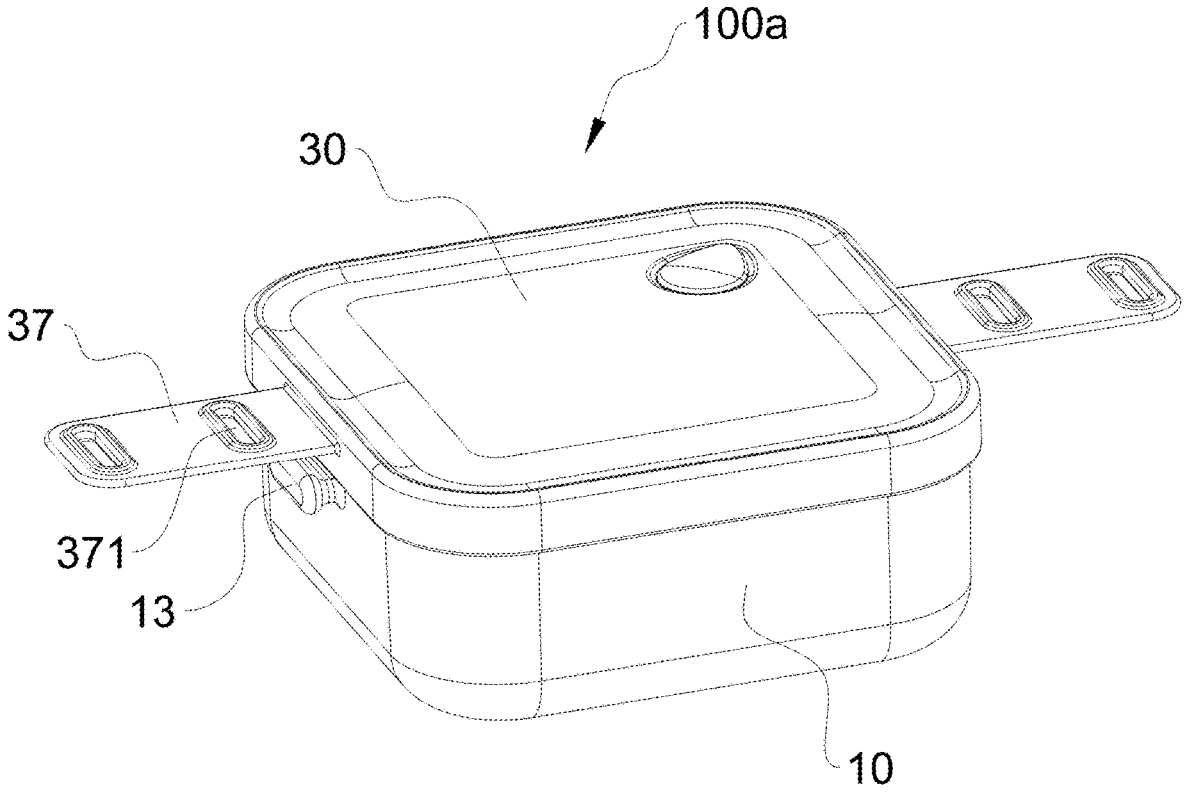
FIG. 8 is a schematic view of a second usage combination mode of the multi-functional flexible steamer of FIG. 1.

A second combination usage mode is a combination of the first body 10 and the cover 30. As shown in FIG. 8, the second usage combination mode of the steamer 100*a* of the first embodiment is presented. In this usage mode, the steamer 100*a* of the first embodiment can be put into the microwave oven for simply heating food, such as heating cooked food. In this way, if a user has already cooked food at home and brings the cooked food to his office or other places, the second body 20 can be out of used, which can reduce a weight and a volume that are carried.

That is, the steamer 100*a* of the first embodiment not only can use the microwave oven to complete simple heating functions, but also can use the microwave oven to steam and cook the food, which has diversified functions thereof. At the same time, the combination modes can also be changed according to actual needs. Secondly, the steamer 100*a* of the first embodiment has functions such as lowering blood sugar and cholesterol during the cooking process, which is beneficial to human health. Furthermore, the steamer 100*a* of the first embodiment is made of flexible materials such as silicone rubber, which is easy to be carried and difficult to be damaged due to have functions of preventing collisions and falls thereof.

Preferably, the first body 10 includes a second spacer 112 arranged in the first receiving room 11 to divide the first receiving room 11 into at least two cavities 110. In this way, different foods can be placed in the first receiving room 11 of the first body 10, for example, rice is placed in one cavity 110 and vegetables are placed in the other cavity 110. In this way, when heating the food, the oil in the dishes will not flow into the rice. As shown in FIG. 3 and FIG. 4, the first body 10 of the first embodiment is equipped with four intersecting second spacers 112 in the first receiving room 11 to divide the first receiving room 11 into four cavities 110. In this way, the first body 10 of the first embodiment can accommodate four different types of food ingredients. Of course, when cooking the ingredients in the second body 20, all the four cavities 110 of the first body 10 can be filled with water. That is, in the first embodiment of the present disclosure, the first receiving room 11 of the first body 10 is divided into compartments, but in other embodiments of the present disclosure, the first receiving room 11 of the first body 10 is not divided into compartments.

Figure 5:
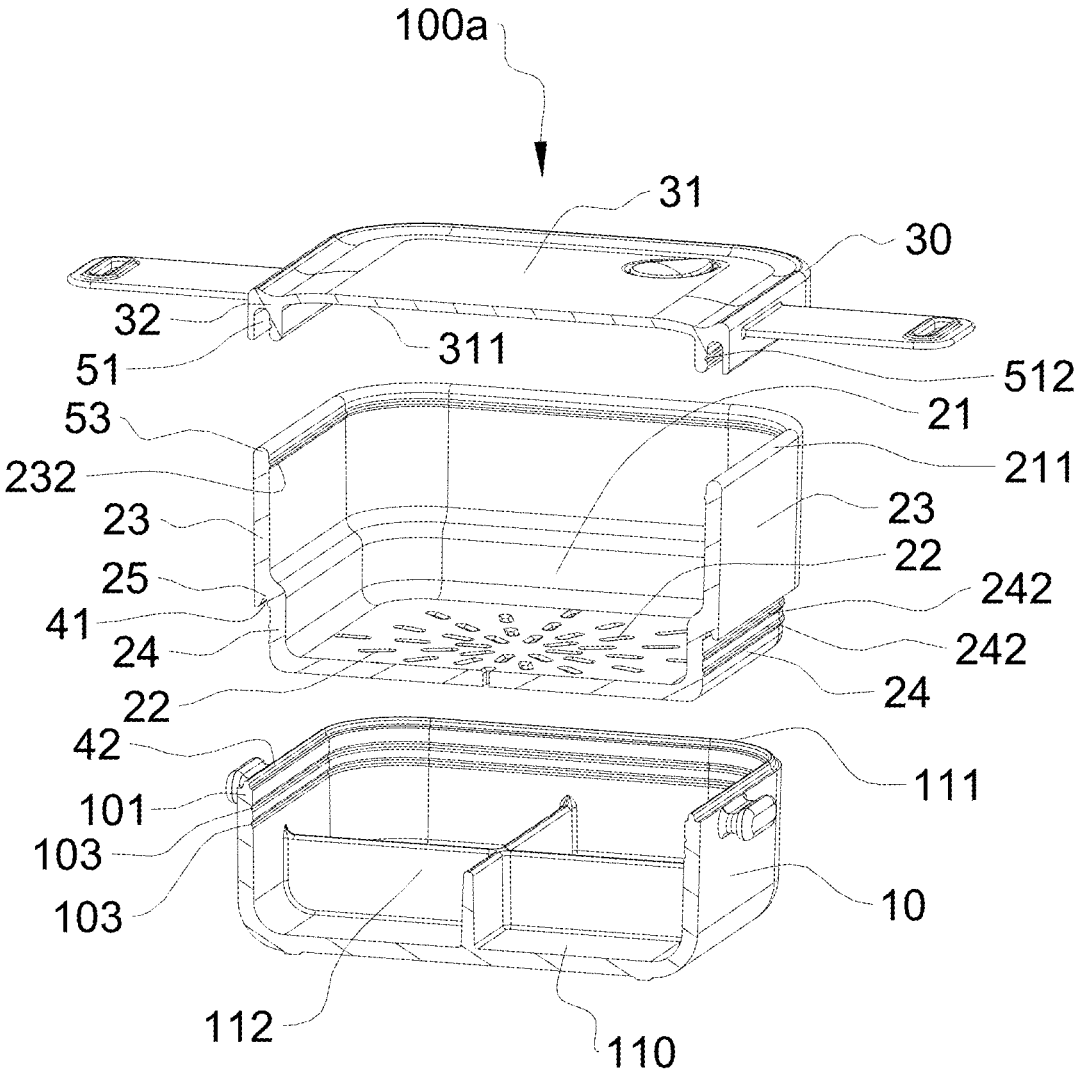
FIG. 5 is an exploded, schematic view of the multi-functional flexible steamer of FIG. 4.

Referring to FIG. 4 and FIG. 5, in the first embodiment of the present disclosure, the second body 20 includes an exposing portion 23 and an inserting portion 24 arranged below the exposing portion 23, and a transition step 25 formed at a connection between the exposing portion 23 and the inserting portion 24. In the first embodiment of the present disclosure, an outer diameter of the exposing portion 23 is larger than that of the inserting portion 24 that is arranged below the exposing portion 23. The inserting part 24 is configured to extend into the first receiving room 11 of the first body 10. An upper end 101 of the first body 10 is connected to the transition step 25 of the second body 20 through a first anti-stop structure 40, and the cover 30 is connected to the exposing portion 23 of the second body 20 through a second anti-stop structure 50. That is, in the first embodiment, all the second body 20, the first body 10 and the cover 30 are connected together by using the anti-stop locking structure, which is quick assembly and connection thereamong, and the anti-stop locking structure can effectively prevent leakage and protrusion deformation caused by deformation and loose fit of the opened-end of the first body 10 or the second body 20, and prevent the connection from moving left and right. At the same time, the inner and outer sides of the anti-stop locking structure also serve as a double-layer seal role thereof.

Figure 6:
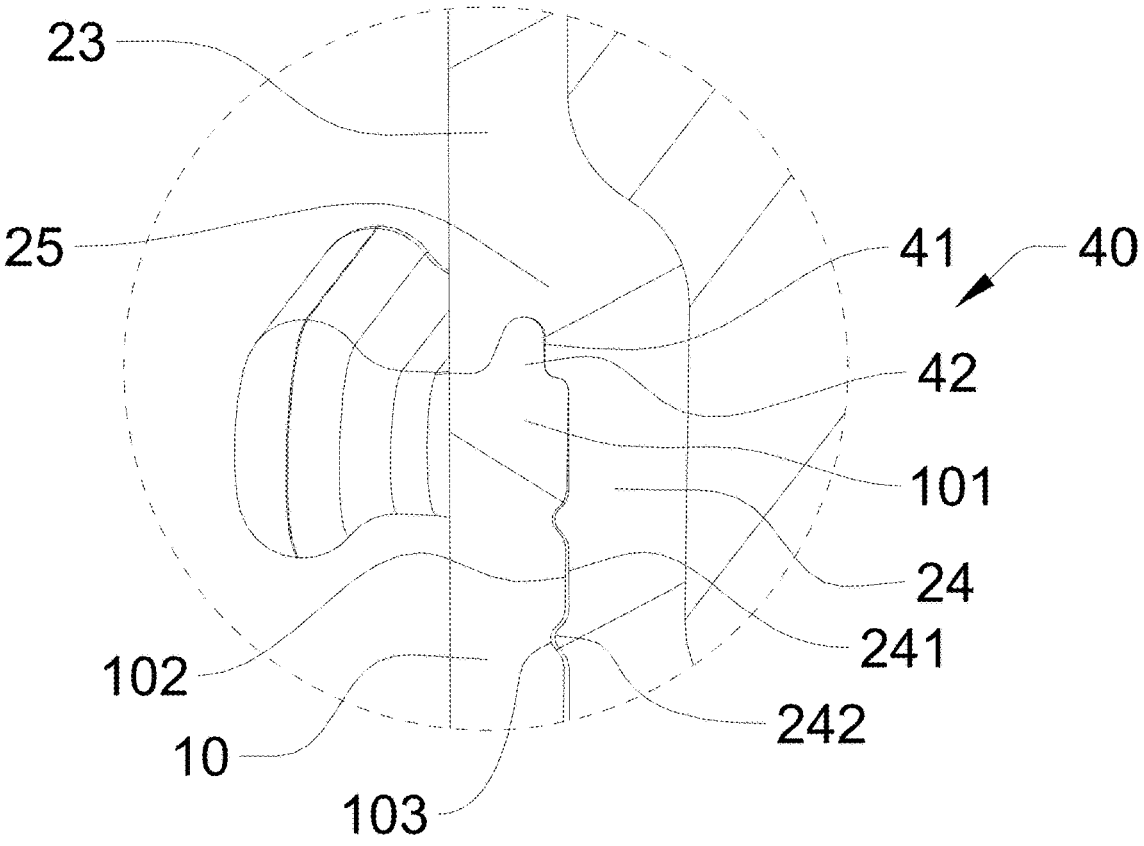
FIG. 6 is a partial enlarged view of a first anti-stop structure of the multi-functional flexible steamer of FIG. 4.

Specifically, referring to FIG. 6, in the first embodiment of the present disclosure, the first anti-stop structure 40 includes: a first plugging slot 41 arranged on the transition step 25 of the second body 20, and a first protrusion 42 arranged on the upper end 101 of the first body 10. When the inserting portion 24 of the second body 20 is inserted into the first receiving room 11 of the first body 10, the first protrusion 42 can be inserted upwards into the first plugging slot 41. In the first embodiment of the present disclosure, the first plugging slot 41 and the first protrusion 42 are cooperatively to form the anti-stop structure, that is, when the second body 20 is inserted downwards into the first body 10, the first protrusion 42 of the first body 10 is reversely inserted upwards into the first plugging slot 41 of the second body 20, which are connected by a trapezoidal structure. Such anti-stop structure can prevent the opened-end of the top portion 111 of the first body 10 from deforming and expanding outwardly, resulting in affecting aesthetics and the sealing function thereof, to prevent the connection between the first body 10 and the second body 20 from moving left and right. Secondly, the anti-stop structure ensures a sealed fit at the connection point of the transition step 25 between the second body 20 and the first body 10, thereby improving the sealing performance and preventing air leakage during the cooking process.

The first anti-stop structure 40 of the first embodiment can also be set in reverse, which specifically includes: a first protrusion 42 arranged on the transition step 25 of the second body 20, and a first plugging slot 41 arranged on the upper end 101 of the first body 10.

In the first embodiment of the present disclosure, when the inserting portion 24 extends into the first receiving room 11, an outer wall 241 of the inserting portion 24 tightly fits with an inner wall 102 of the first body 11, which can improve a tight sealing effect that the second body 20 is inserted and matched with the first body 10.

Furthermore, referring to FIG. 6, in the first embodiment of the present disclosure, a sealing rib 242 is formed on the outer wall 241 of the inserting portion 24, and a sealing groove 103 is formed on the inner wall 102 of the first body 10, and wherein the sealing rib 242 is embedded into the sealing groove 103 to further increase the firmness of the connection between the first body 10 and the second body 20, and further enhance the sealing effect at the connection between the first body 10 and the second body 20. The fitting of the sealing rib 242 with the sealing groove 103 can also prevent the opened-end of the upper end 111 of the first pot body 10 from deforming, and ensure the tight fitting of the anti-stop structure, so as to avoid leakage and deformation thereof. At the same time, it can also prevent the connection between the first body 10 and the second body 20 from moving up and down, thereby further improving the sealing effect at the connection between the first body 10 and the second body 20.

The sealing rib 242 and the sealing groove 103 of the first embodiment can also be set in reverse, that is, the sealing groove 103 is formed on the outer wall 241 of the inserting portion 24, and the sealing rib 242 is formed on the inner wall 102 of the first body 10.

The first anti-stop structure 40 formed by the first plugging slot 41 and the first protrusion 42, as well as the fitting structure of the sealing rib 242 and the sealing groove 103, respectively correspond to two types of clamping positions at the connection between the first body 10 and the second body 20. These two clamping positions prevent the connection between the first body 10 and the second body 20 from moving up and down, left and right, while also providing a dual sealing effect thereof. The anti-stop structure can more effectively prevent deformation of the opened-ends of the first body 10 or the second body 20, as well as leakage and deformation caused by loose fit of the sealing ribs. It also can block tension deformation at the opened-end of the body below the connection thereof, and also provide a double-layer seal thereof.

Preferably, the outer wall 241 of the inserting portion 24 and the inner wall 102 of the first body 10 are provided with two sets of sealing ribs 242 and sealing grooves 103 that are interlocked with each other, which can also achieve a double-layer sealing effect in a vertical direction thereof.

Figure 7:
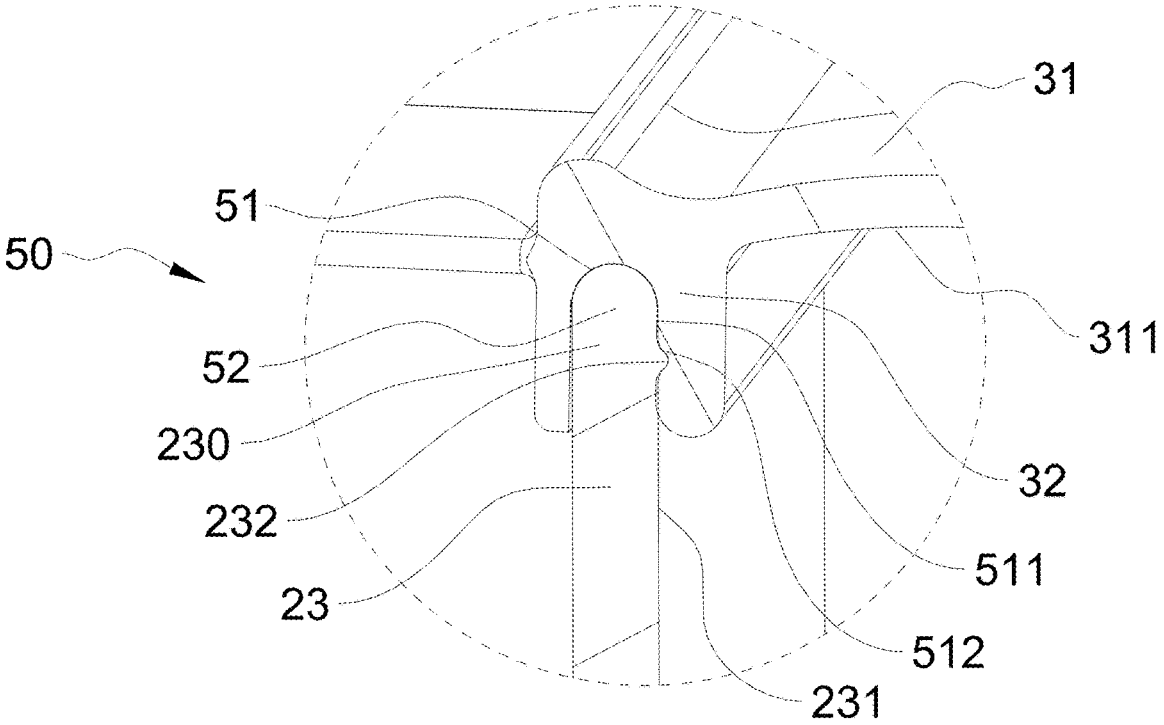
FIG. 7 is a partial enlarged view of a second anti-stop structure of the multi-functional flexible steamer of FIG. 4.

Referring to FIG. 7, in the first embodiment of the present disclosure, the cover 30 includes a base 31, a clamping block 32 arranged on a lower portion 311 of the base 31. The second anti-stop structure 50 includes: a U-shaped groove 51 arranged on a side of the clamping block 32 that faces the second body 20, and a U-shaped protrusion 52 arranged on a top end 230 of the exposing portion 23 of the second body 20. In the first embodiment of the present disclosure, the U-shaped groove 51 is arranged in an inverted state. When the cover 30 is covered onto the exposing portion 23 of the second body 20, the U-shaped protrusion 52 of the exposing portion 23 can be inserted upwards into the U-shaped groove 51. In the first embodiment of the present disclosure, the second body 20 and the cover 30 are engaged with each other by the plug-in connection between the U-shaped groove 51 and the U-shaped protrusion 52. The U-shaped groove 51 and the U-shaped protrusion 52 of the exposing portion 23 in the first embodiment also form the anti-stop structure, that is, when the cover 30 is covered downwards on the exposing portion 23 of the second body 20, the U-shaped protrusion 52 of the exposing portion 23 is inserted upwards into the U-shaped groove 51. Such anti-stop structure also has the following effects: firstly, it can prevent the opened-end of the top portion 211 of the second body 20 from deforming and expanding outwardly, result in affecting aesthetics and sealing functions thereof, so that the anti-stop structure can prevent the connection between the second body 20 and the cover 30 from moving left and right. Secondly, the anti-stop structure ensures a sealing fit at the connection between the second body 20 and the cover 30, with the U-shaped protrusion 52 and U-shaped groove 51 forming an interference fit to ensure a tight seal and improve the sealing performance thereof.

The second anti-stop structure 50 of the first embodiment can also be set in reverse, which specifically includes: the U-shaped protrusion 52 arranged on a side of the clamping block 32 that faces the second body 20, and the U-shaped groove 51 arranged on the top end 230 of the exposing portion 23 of the second body 20.

Preferably, a sealing groove 512 is arranged on a groove wall 511 of the U-shaped groove 51, and a sealing rib 232 is arranged on an inner wall 231 of the top end 230 of the exposing portion 23. The sealing rib 232 is embedded into the sealing groove 512. A cooperation between the sealing rib 232 and the sealing groove 512 further enhances the firmness and sealing of the connection between the second body 20 and the cover 30. The fitting of the sealing rib 232 with the sealing groove 512 can also prevent the opened-end of the top portion 211 of the second body 20 from being deformation and avoid an occurrence of leakage and protruding deformation due to the loose fit of the anti-stop structure. It can also prevent the connection between the second body 20 and the cover 30 from moving up and down, and further improve the sealing effect at the connection between the second body 20 and the cover 30.

The sealing rib 232 and the sealing groove 512 of the first embodiment can also be set in reverse, that is, the sealing rib 232 is arranged on the groove wall 511 of the U-shaped groove 51, and the sealing groove 232 is arranged on the inner wall 231 of the top end 230 of the exposing portion 23.

Figure 9:
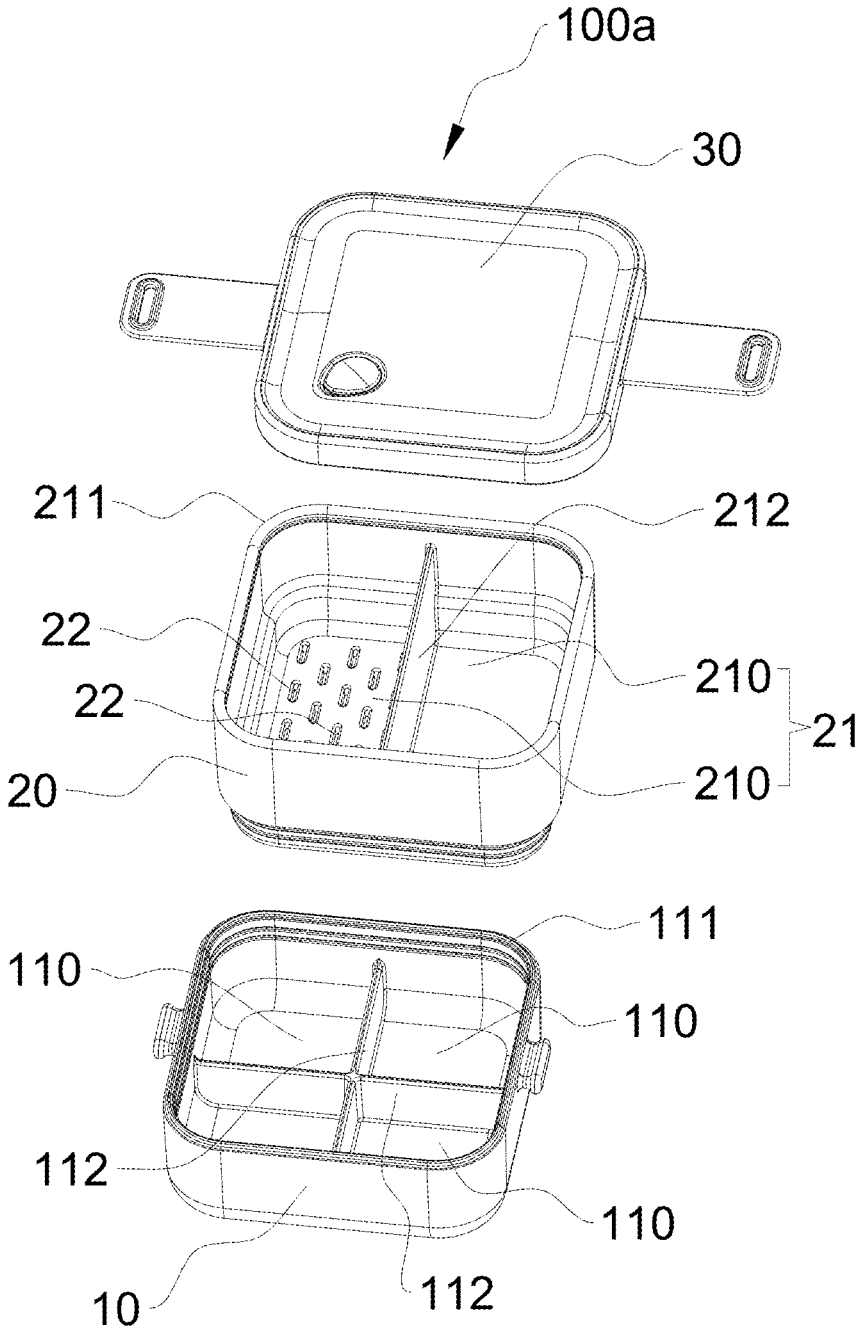
FIG. 9 is a schematic view of a multi-functional flexible steamer used for a microwave oven in accordance with a second embodiment of the present disclosure.
Figure 10:
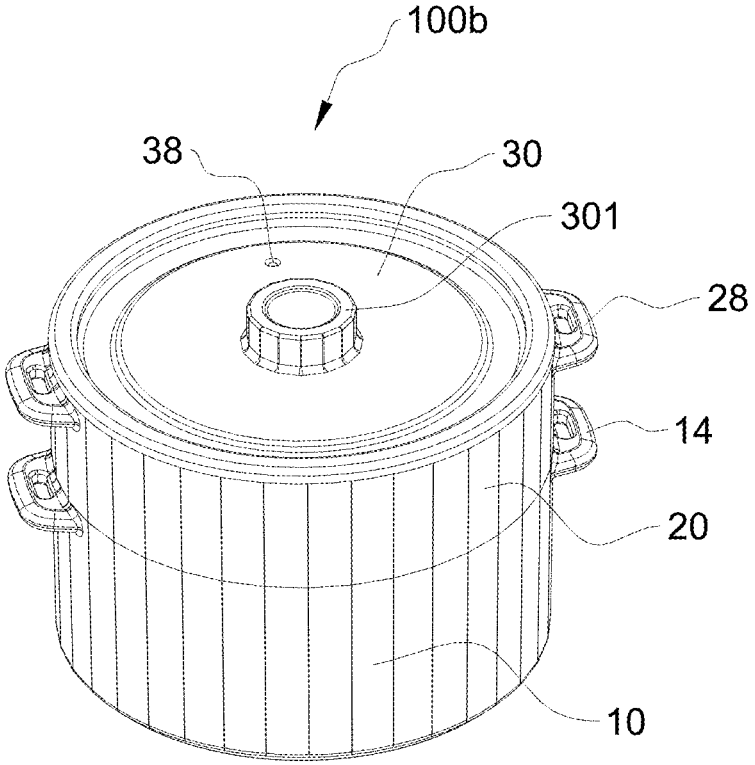
FIG. 10 is a schematic view of a multi-functional flexible steamer used for a microwave oven in accordance with a third embodiment of the present disclosure.
Figure 11:
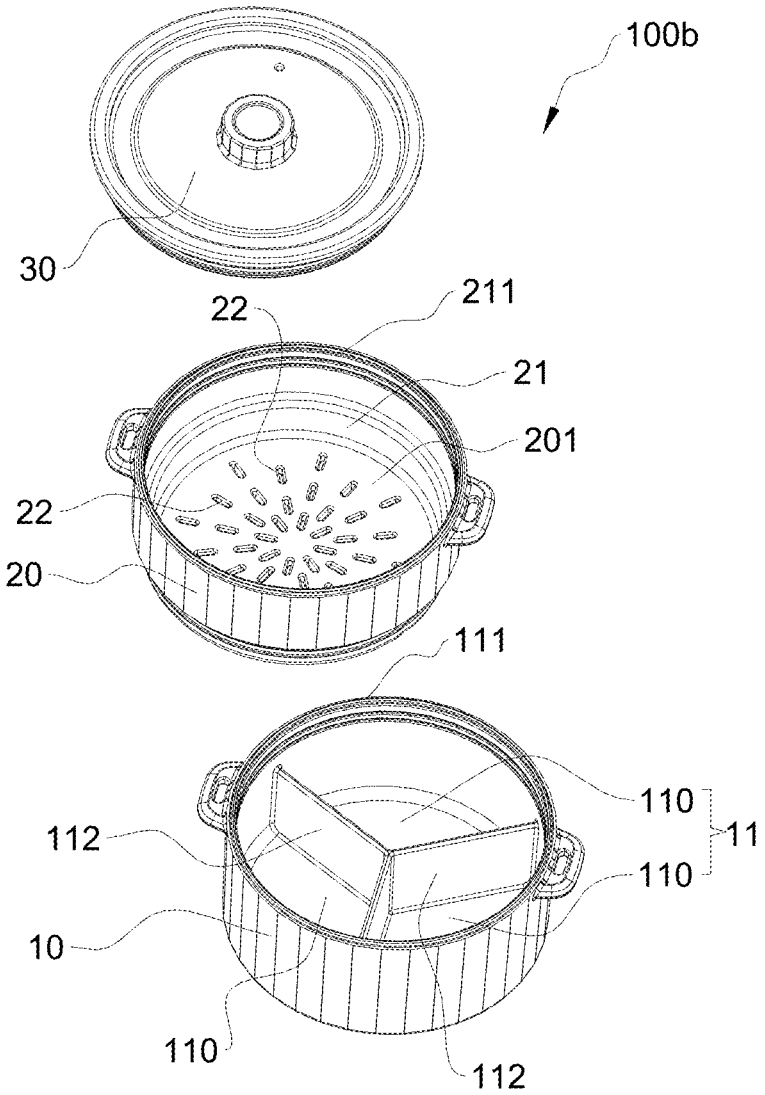
FIG. 11 is an exploded, schematic view of the multi-functional flexible steamer of FIG. 10.

Referring to FIG. 9, a multi-functional flexible steamer 100*a* according to a second embodiment of the present disclosure is provided. A difference between the second embodiment and the first embodiment is that: the second body 20 of the second embodiment includes a first spacer 212 arranged in the second receiving room 21 to divide the second receiving room 21 into at least two cavities 210, wherein the plurality of holes 22 is arranged on a bottom of at least one of the at least two cavities 210, and there is no holes 22 arranged on a bottom of the other of the at least two cavities 210 for resulting in a sealed state at the bottom thereof. That is, the second body 20 of the second embodiment is divided into two cavities 210, the plurality of holes 22 is arranged on the bottom of one cavity 210, while there is no holes 22 arranged on the bottom of the other cavity 210, as shown in FIG. 7, in the second embodiment of the present disclosure, in the two cavities 210 of the second body 20, the cavity 210 on the left is provided with the plurality of holes 22 formed at the bottom of the left cavity 210, and the bottom of the cavity 210 on the right is sealed without providing the holes 22, so the left cavity 210 can be connected with the first receiving room 11 of the first body 10, and the steam generated by heating in the first receiving room 11 can enter into the left cavity 210, so the left cavity 210 of the second body 20 in the second embodiment can be used to steam rice and vegetables, while the cavity 210 on the right can be used to cook congee and stew eggs etc., thereby expanding the steaming and cooking functions of the second body 20.

Referring to FIG. 10 to FIG. 14, a multi-functional flexible steamer 100*b* according to a third embodiment of the present disclosure is provided. A difference between the third embodiment and the first embodiment is that: in the third embodiment, all the first body 10, the second body 20 and the cover 30 are circular.

At the same time, in the third embodiment, the cover 30 is provided with an exhaust vent 38 and a handle 301, a first bar 28 is arranged on a side wall of the second body, and a second bar 14 is arranged on a side wall of the first body 10. All the handle 301, the first bar 28 and the second bar 14 are provided to be convenient for lifting, retrieving and placing the steamer 100*b*.

Furthermore, the multi-functional flexible steamer 100*b* of the third embodiment also has the following differences.

Figure 12:
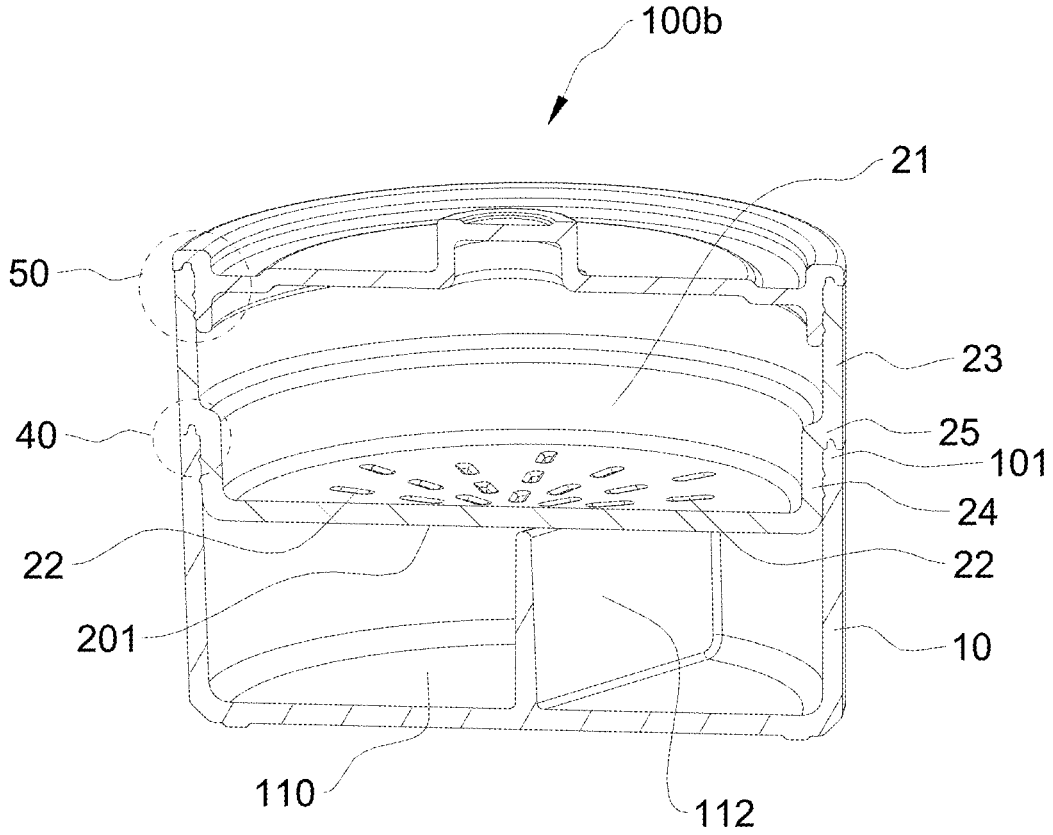
FIG. 12 is a cross-sectional view of the multi-functional flexible steamer of FIG. 10.
Figure 13:
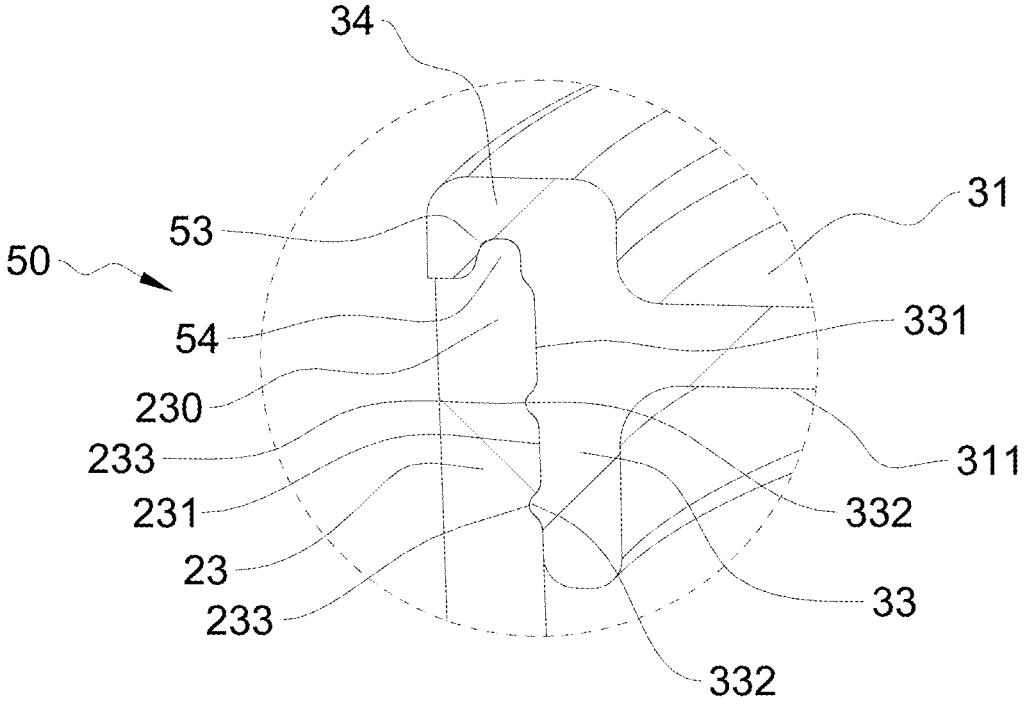
FIG. 13 is a partial enlarged view of a second anti-stop structure of the multi-functional flexible steamer of FIG. 12.

Referring to FIG. 12 and FIG. 13, the cover 30 includes a base 31, a second inserting wall 33 arranged downwards at a lower portion 311 of the base 31, and a fastening step 34 arranged on the outer side of the first inserting wall 33. In the third embodiment of the present disclosure, the second anti-stop structure 50 includes: a second plugging slot 53 arranged on the fastening step 34, and a second protrusion 54 arranged at the top end 230 of the exposing portion 23 of the second body 20. When the cover 30 covers on the exposing portion 23 of the second body 20, the second protrusion 54 can be inserted upwards into the second plugging slot 53.

That is, the cover 30 of the third embodiment is different from that of the first embodiment. In the third embodiment, when the cover 30 is covered on the second body 2, the first inserting wall 33 of the cover 30 is inserted into the inner side of the exposing portion 23 of the second body 20 to provide interference fit thereof, at the same time, combined with the cooperation of the second anti-stop structure 50 between the cover 30 and the second body 20, the connection between the cover 30 and the second body 20 is more firm and the sealing performance is better. The second plugging slot 53 is a trapezoidal slot, and correspondingly, the second protrusion 54 is also a trapezoidal protrusion. The second anti-stop structure 50 formed by the second plugging slot 53 and the second protrusion 54 is also a type of anti-stop structure, that is, when the cover 30 is covered downwards on the top end 230 of the exposing portion 23 of the second body 20, the second protrusion 54 is reversely inserted upwards into the second plugging slot 53, and they are fit with each other through trapezoidal structures. Such anti-stop structure also has the following effects: firstly, it can prevent the opened-end of the top portion 211 of the second body 20 from deforming and expanding outwardly, so that the anti-stop structure can prevent the connection between the second body 20 and the cover 30 from moving left and right; secondly, the anti-stop structure can provide a sealed fit at the connection between the second body 20 and the cover 30, thereby improving the sealing performance and preventing air leakage during the cooking process thereof.

The anti-stop structure 50 of the third embodiment of the present disclosure can be reversely arranged, which specifically includes: the second protrusion 54 arranged on the fastening step 34, and the second plugging slot 53 arranged at the top end 230 of the exposing portion 23 of the second body 20.

Furthermore, referring to FIG. 13, in the third embodiment of the present disclosure, a sealing rib 332 is formed on an outer wall 331 of the first inserting wall 33 of the cover 30, and a sealing groove 233 is formed on an inner wall 231 of the top end 230 of the exposing portion 23 of the second body 20. The sealing rib 332 is embedded into the sealing groove 233. the sealing rib 332 of the first inserting wall 33 and the sealing groove 233 of the inner side wall 231 of the exposing portion 23 are embedded with each other to further enhance the connection firmness and the sealing performance thereof. The sealing rib 332 embedded into the sealing groove 233 can also prevent the opened-end of the top portion 211 of the second body 20 from being deformation and avoid an situation where the anti-stop structure at the connection between the second body 20 and the cover 30 is not tightly fitted, resulting in leakage and protruding deformation thereof. It can also limit upward and downward movement of the connection between the second body 20 and the cover 30, and further improve the sealing effect at the connection between the second body 20 and the cover 30.

The sealing rib 332 and the sealing groove 233 of the third embodiment of the present disclosure can also be set in reverse, that is: the sealing groove 233 is formed on the outer wall 331 of the first inserting wall 33, and the sealing rib 332 is formed on the inner wall 231 of the top end 230 of the exposing portion 23 of the second body 20.

Figure 14:
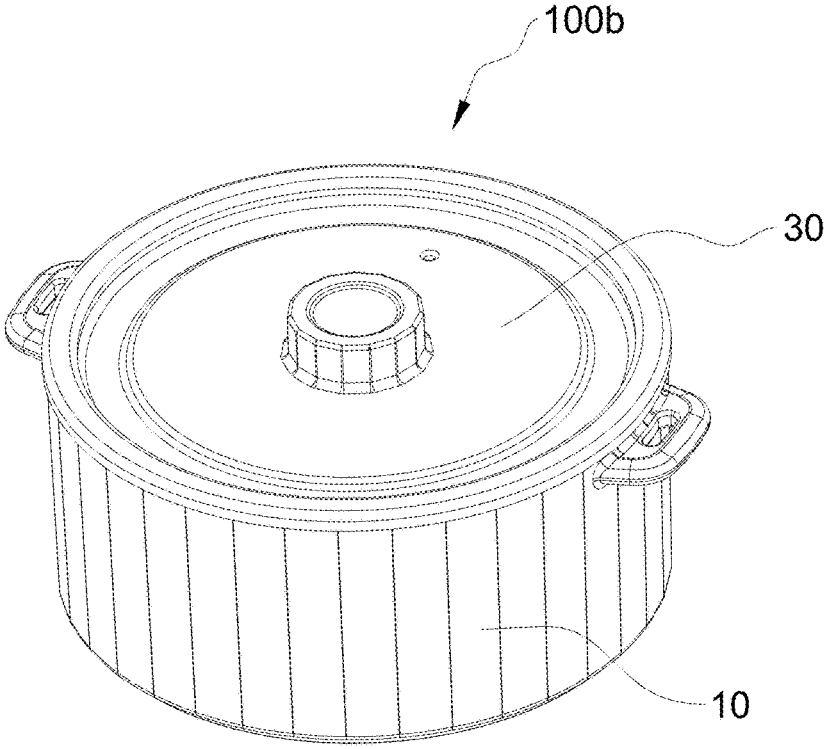
FIG. 14 is a schematic view of a second usage combination mode of the multi-functional flexible steamer of FIG. 10.
Figure 15:
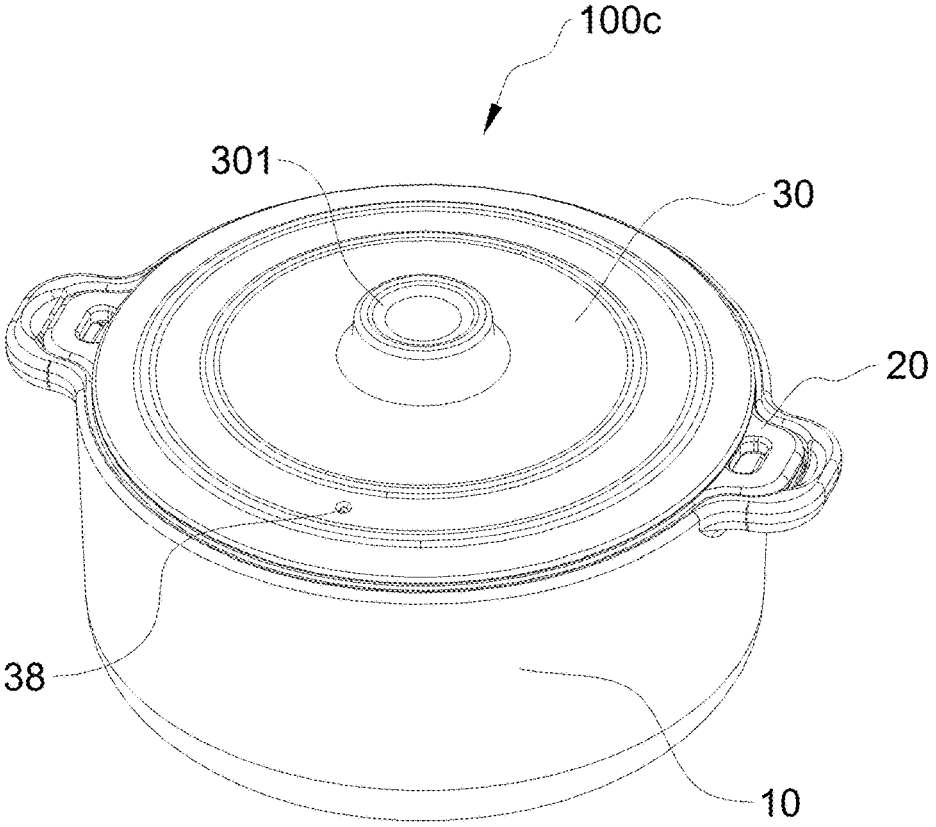
FIG. 15 is a schematic view of a multi-functional flexible steamer used for a microwave oven in accordance with a fourth embodiment of the present disclosure.
Figure 16:
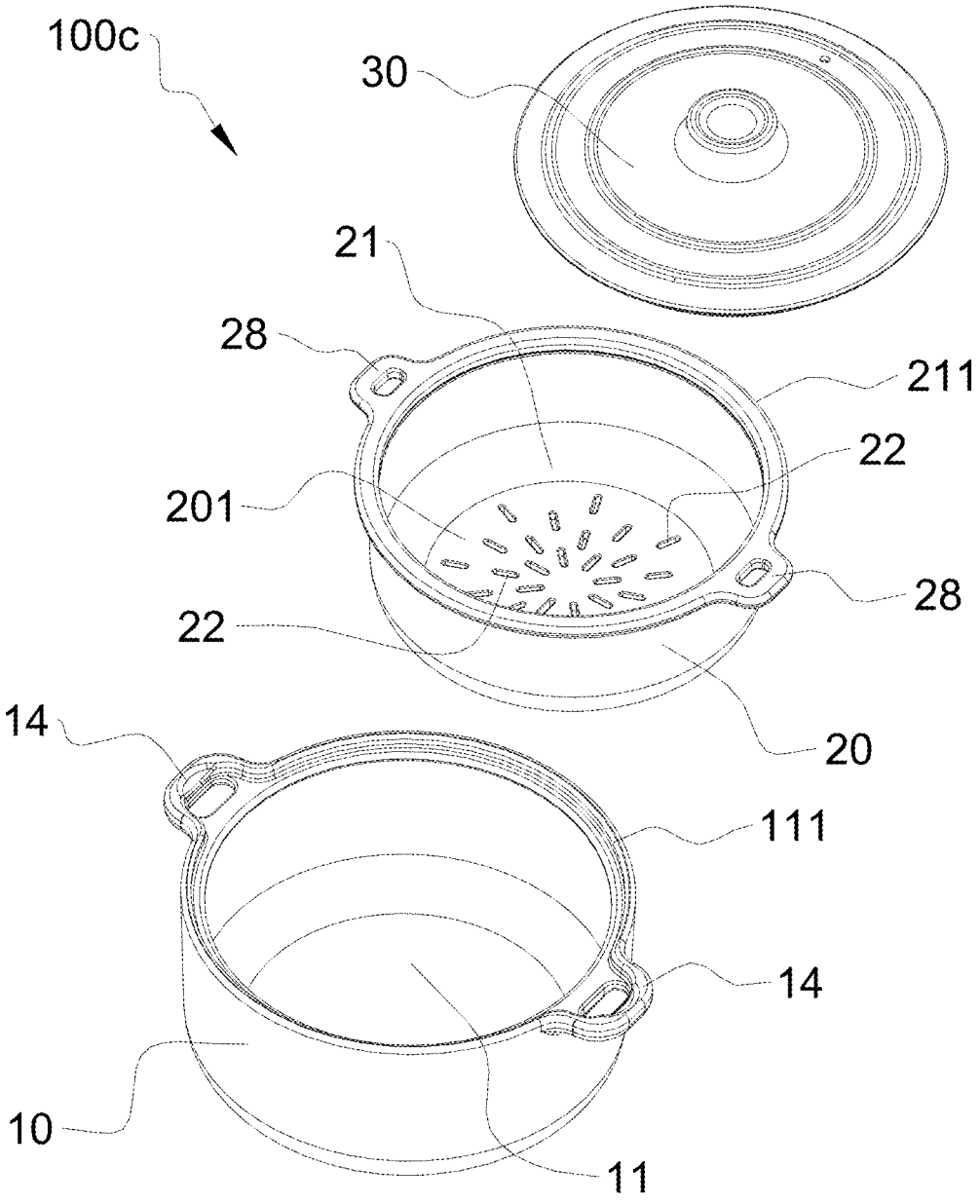
FIG. 16 is an exploded, schematic view of the multi-functional flexible steamer of FIG. 15.

In the third embodiment of the present disclosure, a height of the first body 10 is higher than that of the first body 10 of the first embodiment, so that the first body 10 can be conveniently used for steaming eggs, and cooking congee etc., by providing a larger capacity thereof. At the same time, the cover 30 can be placed on the second body 20 or the first body 10 for being separately used, as shown in FIG. 14, a combination of the cover 30 and the first body 10 is provided. The first body 10 and the second body 20 can also be divided into compartments or not be divided into compartments.

Referring to FIG. 15 to FIG. 19, a multi-functional flexible steamer 100*c* according to a fourth embodiment of the present disclosure is shown. A difference between the fourth embodiment and the first embodiment is that: in the fourth embodiment, all the first body 10, the second body 20 the cover 30 are circular.

At the same time, in the fourth embodiment of the present disclosure, the cover includes an exhaust vent 38 and a handle 301, a first bar 28 arranged on the side wall of the second body 20 and a second bar 14 arranged on the side wall of the first body 10.

Furthermore, the multi-functional flexible steamer 100*c* of the fourth embodiment also has the following differences.

Figure 17:
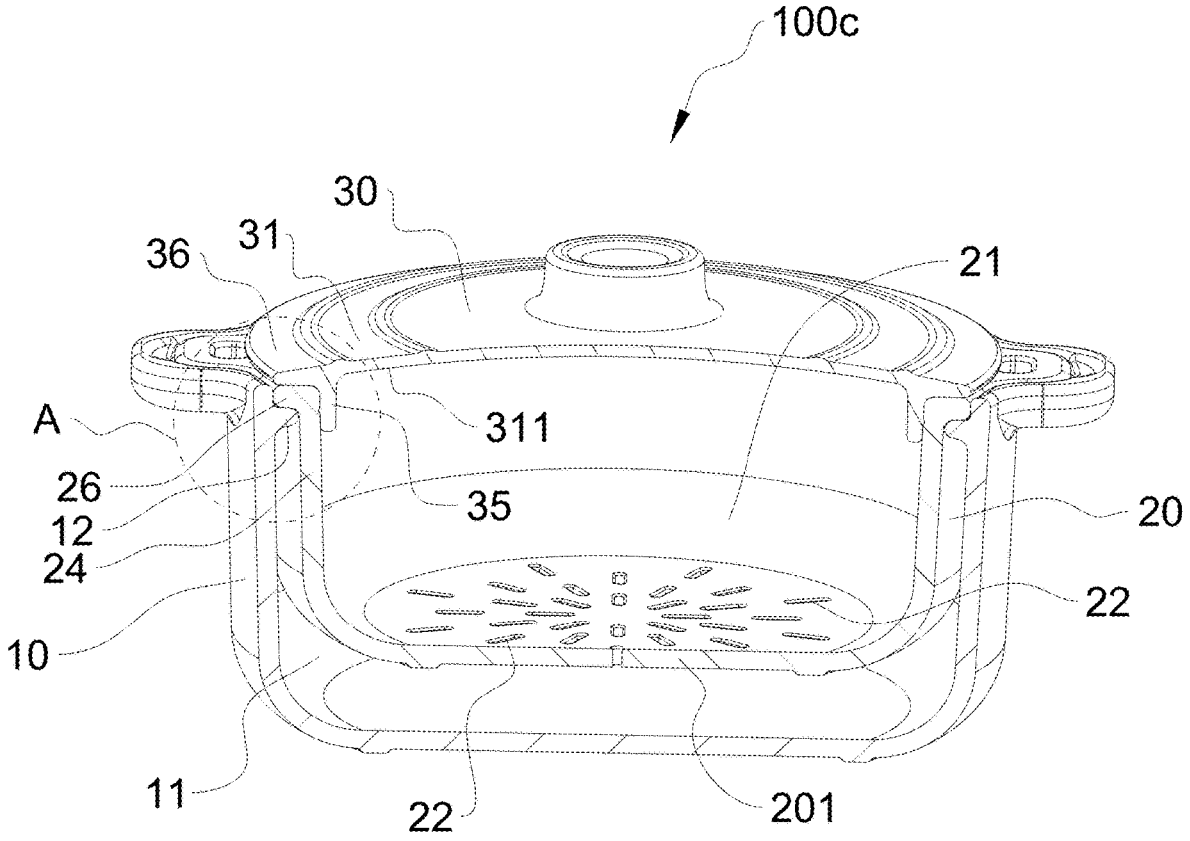
FIG. 17 is a cross-sectional view of the multi-functional flexible steamer of FIG. 15.
Figure 18:
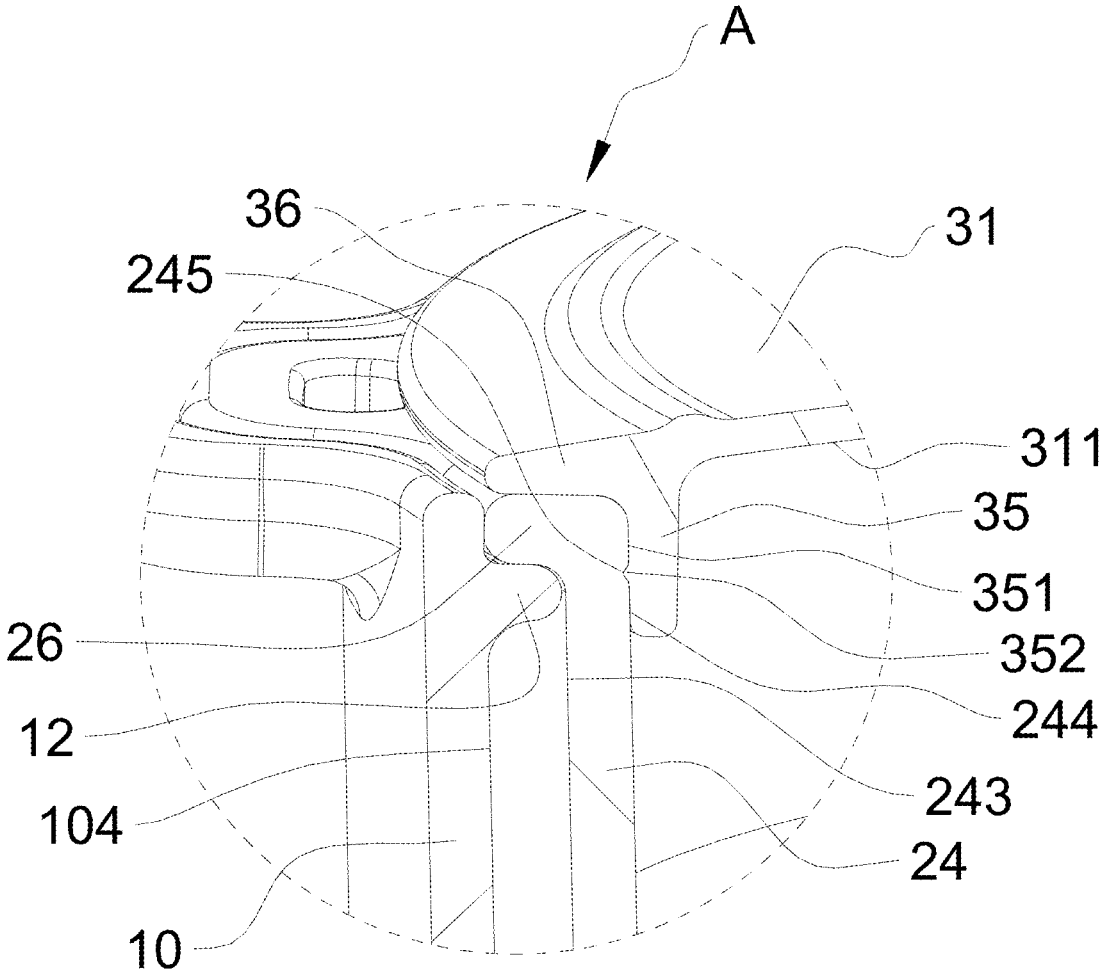
FIG. 18 is an enlarged schematic view of a circle A of FIG. 17.

Referring to FIG. 17 and FIG. 18, in the fourth embodiment, the second body 20 includes an inserting portion 24 and a first connecting step 26 arranged on a top outer side 243 of the inserting portion 24, and a second connecting step 12 is arranged on a top inner side 104 of the first body 10. When the inserting portion 24 of the second body 20 is inserted into the first receiving room 11 of the first body 10, the first connecting step 26 of the second body 20 is overlapped on the second connecting step 12 of the first body 10.

That is, the second body 20 of the fourth embodiment is different from that of the first embodiment. In the fourth embodiment, the second body 20 does not have the exposing portion 23 at the upper end thereof, but directly provides the first connecting step 26 protruding outwardly from the top outer side 243 of the inserting portion 24. Similarly, the first body 10 also provides the second connecting step 12 protruding inwardly from the top inner side 104 thereof. In this way, the connections between the second body 20 and the first body 10 are connected by an overlapping connection way, rather than a plug-in connection way as shown in the first embodiment. Such overlapping connection way can facilitate quick retrieval and placement between the second body 20 and the first body 10.

In the fourth embodiment, the cover 30 includes a base 31, a second inserting wall 35 arranged downwards at a lower portion 311 of the base 31, and a cover plate 36 arranged on the outer side of the second inserting wall 35, wherein the cover plate 36 presses onto the first connecting step 26 or the second connecting step 12. That is, when the cover 30 of the fourth embodiment is covered on the second body 20, the second inserting wall 35 of the cover 30 will be inserted into the inner wall of the second body 20 for providing interference fit therebetween to ensure the connection tightness thereof. At the same time, the cover plate 36 of the cover 30 also covers on the first connecting step 26.

Preferably, referring to FIG. 18, in the fourth embodiment, a sealing rib 352 is formed on an outer wall 351 of the second inserting wall 35, and a sealing groove 245 is formed on a top inner side 244 of the inserting portion 24 of the second body 20. The sealing rib 352 is embedded into the sealing groove 245. The sealing rib 352 of the second inserting wall 35 of the cover 30 is embedded and matched with the sealing groove 245 of the top inner side 244 of the inserting portion 24, thereby further enhancing the firmness and sealing effect of the connection between the cover 30 and the second body 20.

The sealing rib 352 and the sealing groove 245 of the fourth embodiment can also be set in reverse, that is: the sealing groove 245 is formed on the outer wall 351 of the second inserting wall 35, and the sealing rib 352 is formed on the top inner side 244 of the inserting portion 24 of the second body 20.

Figure 19:
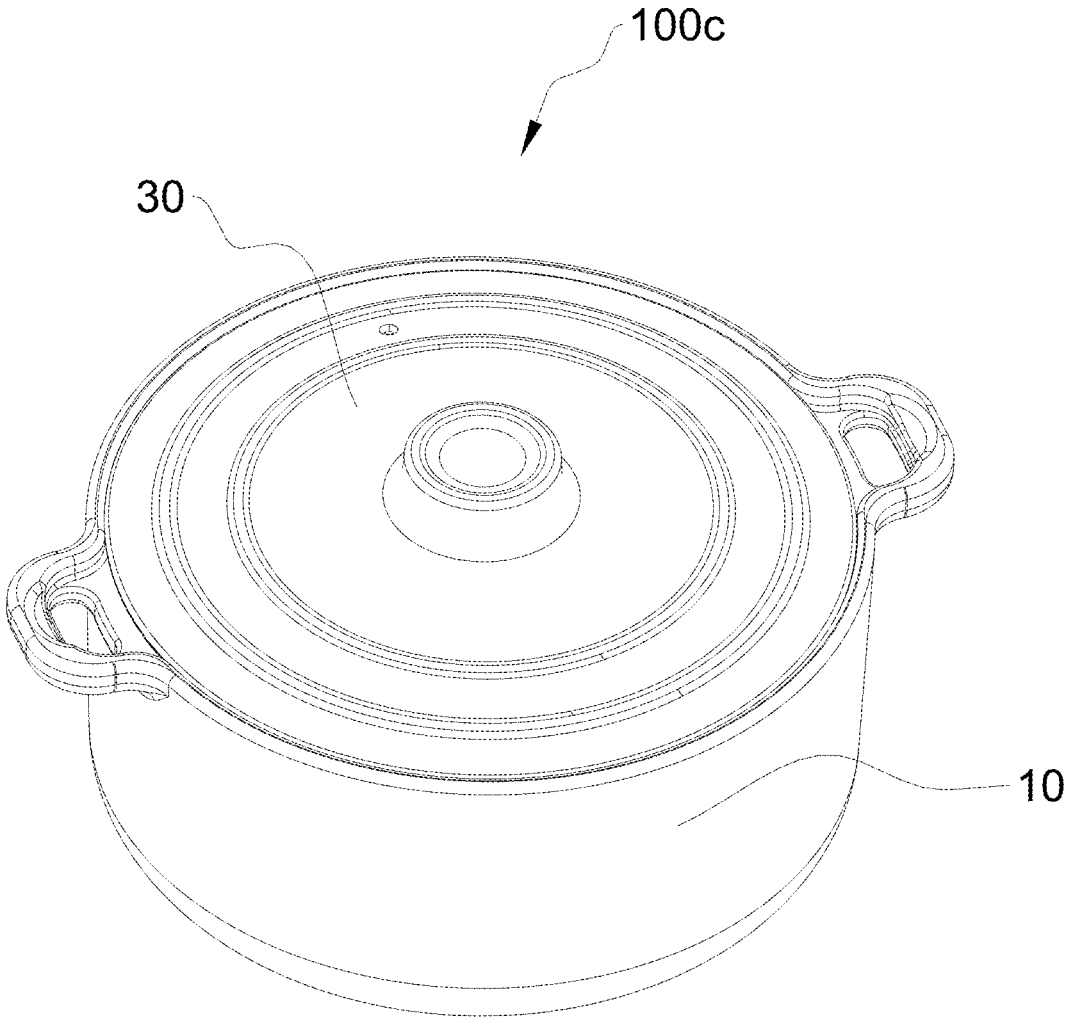
FIG. 19 is a schematic view of a second usage combination mode of the multi-functional flexible steamer of FIG. 15.

At the same time, the cover 30 of the fourth embodiment can be placed on the second body 20 or the first body 10 for being separately used, as shown in FIG. 19, a combination of the cover 30 and the first body 10 is provided, which uses the first body 10 alone to process or hold some food. The first body 10 and the second body 20 can also be divided into compartments or not be divided into compartments.

The multi-functional flexible steamer 100*c* of the fourth embodiment also has the microwave oven use effect of reducing blood sugar, carbon and fat as in the first embodiment. The steamer 100*c* of the fourth embodiment is more convenient for draining noodles, vegetables and fruits, such as heating or soaking the noodles in the microwave oven and lifting the upper layer for draining, which is also suitable for cleaning and draining fruits and vegetables, similar to a draining column.

The multi-functional flexible steamers 100*a*, 100*b*, 110*c* of the above embodiments can be used in the microwave oven to steam rice, vegetables, meat, eggs and cooking congee etc., which enriches functions of the product and improves user experiences thereof.

The specific embodiments of the present disclosure are described in detail above in combination with the accompanying drawings, but not limited to the above embodiments. Various changes can also be made within the knowledge of an ordinary skilled person in the art without departing from the purpose of the present disclosure, each feature or element can be used alone or in other various combinations within the principles of the present disclosure to the full extent indicated by the broad general meaning of the terms in which the appended claims are expressed.

What is claimed is:

1. A multi-functional flexible steamer used for a microwave oven comprising:

a first body comprising a first receiving room with an opened-end top portion thereof;

a second body comprising a second receiving room with an opened-end top portion thereof, and a plurality of holes arranged on a bottom end of the second body and connected to the second receiving room; and wherein the second body can be placed on the first body so that the bottom end of the second body extends into the first receiving room; and a cover covered on the second body or the first body;

wherein all the first body, the second body and the cover are made of materials that are flexible and resistant to be heated in a microwave oven;

wherein the second body comprises an exposing portion and an inserting portion arranged below the exposing portion;

wherein a transition step is formed at a connection between the exposing portion and the inserting portion, the inserting portion is configured to extend into the first receiving room;

an upper end of the first body is connected to the transition step of the second body through a first anti-stop structure, and the cover is connected to the exposing portion of the second body through a second anti-stop structure;

wherein the first anti-stop structure comprises:

a first plugging slot arranged on the transition step of the second body;

a first protrusion arranged on the upper end of the first body; or the first anti-stop structure comprises:

a first protrusion arranged on the transition step of the second body, and a first plugging slot arranged on the upper end of the first body;

wherein when the inserting portion of the second body is inserted into the first receiving room of the first body, the first protrusion is inserted into the first plugging slot.

2. The multi-functional flexible steamer as claimed in claim 1, wherein the multi-functional flexible steamer is made of silicone rubber.

3. The multi-functional flexible steamer as claimed in claim 1, wherein the multi-functional flexible steamer comprises at least two usage combination modes, wherein a first usage combination mode is a combination of the first body, the second body and the cover; and a second combination mode is a combination of the first body and the cover.

4. The multi-functional flexible steamer as claimed in claim 1, wherein the first body comprises a second spacer arranged in the first receiving room to divide the first receiving room into at least two cavities.

5. The multi-functional flexible steamer as claimed in claim 1, wherein when the inserting portion extends into the first receiving room, an outer wall of the inserting portion tightly fits with an inner wall of the first body.

6. The multi-functional flexible steamer as claimed in claim 5, wherein a sealing rib is formed on the outer wall of the inserting portion, and a sealing groove is formed on the inner wall of the first body; or a sealing groove is formed on the outer wall of the inserting portion, and a sealing rib is formed on the inner wall of the first body; and wherein the sealing rib is embedded into the sealing groove.

7. The multi-functional flexible steamer as claimed in claim 1, wherein the cover comprises a base, a clamping block arranged on a lower portion of the base; and wherein the second anti-stop structure comprises:

a U-shaped groove arranged on a side of the clamping block that faces the second body;

a U-shaped protrusion arranged on a top end of the exposing portion of the second body; or the second anti-stop structure comprises:

a U-shaped protrusion arranged on a side of the clamping block that faces the second body;

a U-shaped groove arranged on a top end of the exposing portion of the second body; and wherein when the cover covers on the exposing portion of the second body, the U-shaped protrusion is inserted into the U-shaped groove.

8. The multi-functional flexible steamer as claimed in claim 7, wherein a sealing groove is arranged on a groove wall of the U-shaped groove, and a sealing rib is arranged on an inner wall of the top end of the exposing portion; or a sealing rib is arranged on a groove wall of the U-shaped groove, and a sealing groove is arranged on an inner wall of the top end of the exposing portion; and wherein the sealing rib is embedded into the sealing groove.

9. The multi-functional flexible steamer as claimed in claim 1, wherein the cover comprises a buckling ear, and a buckling portion arranged on the outer wall of the first body, a buckling hole formed on the buckling ear to buckle with the buckling portion.

10. The multi-functional flexible steamer as claimed in claim 1, wherein a shape of the multi-functional flexible steamer is rectangular or circular.

11. A multi-functional flexible steamer used for a microwave oven comprising:

a first body comprising a first receiving room with an opened-end top portion thereof;

a second body comprising a second receiving room with an opened-end top portion thereof, and a plurality of holes arranged on a bottom end of the second body and connected to the second receiving room; and wherein the second body can be placed on the first body so that the bottom end of the second body extends into the first receiving room; and a cover covered on the second body or the first body;

wherein all the first body, the second body and the cover are made of materials that are flexible and resistant to be heated in a microwave oven;

wherein the second body comprises an exposing portion and an inserting portion arranged below the exposing portion;

wherein a transition step is formed at a connection between the exposing portion and the inserting portion, the inserting portion is configured to extend into the first receiving room;

an upper end of the first body is connected to the transition step of the second body through a first anti-stop structure, and the cover is connected to the exposing portion of the second body through a second anti-stop structure;

wherein the cover comprises a base and a clamping block arranged on a lower portion of the base;

wherein the second anti-stop structure comprises:

a U-shaped groove arranged on a side of the clamping block that faces the second body;

a U-shaped protrusion arranged on a top end of the exposing portion of the second body; or the second anti-stop structure comprises:

a U-shaped protrusion arranged on a side of the clamping block that faces the second body;

a U-shaped groove arranged on a top end of the exposing portion of the second body;

wherein when the cover covers on the exposing portion of the second body, the U-shaped protrusion is inserted into the U-shaped groove.

* * * * *